United States Patent [19]

Carr

[11] 3,964,863

[45] June 22, 1976

[54] METHOD FOR IMPREGNATING WOOD

[76] Inventor: Guy Crockett Carr, 11635 SW. Canyon Road, Beaverton, Oreg. 97005

[22] Filed: Sept. 9, 1974

[21] Appl. No.: 504,592

Related U.S. Application Data

[63] Continuation of Ser. No. 384,552, Aug. 1, 1973, abandoned, which is a continuation of Ser. No. 172,767, Aug. 18, 1971, abandoned.

[52] U.S. Cl. ..... 21/7; 427/439; 427/440

[51] Int. Cl.[2] ..... B27K 3/08; B27K 7/00; B27K 9/00

[58] Field of Search ..... 21/7; 117/116, 147, 117/149; 427/439, 440

[56] References Cited

UNITED STATES PATENTS

| | | | |
|---|---|---|---|
| 2,668,779 | 2/1954 | Herman | 117/147 X |
| 2,786,784 | 3/1957 | Henriksson | 117/116 |
| 3,467,546 | 9/1969 | Page et al. | 117/116 |
| 3,632,409 | 1/1972 | Bearnett | 21/7 X |
| 3,671,299 | 6/1972 | Barnett | 21/7 X |
| 3,677,805 | 7/1972 | Barnett | 21/7 X |

OTHER PUBLICATIONS

Van Groenou et al.; "Wood Preservation," 1951; p. 38.

*Primary Examiner*—Morris O. Wolk
*Assistant Examiner*—Bradley Garris
*Attorney, Agent, or Firm*—Adrian J. La Rue

[57] ABSTRACT

This invention relates to an apparatus and method for impregnating fibrous material, or members having organized capillary networks such as wood, with impregnating fluid and it comprises a pressure vessel in which material to be treated is placed. Impregnating fluid is introduced into the pressure vessel and the pressure is isostatically increased in a cntrolled manner thereby causing the impregnating fluid to be distributed throughout substantially all of the material.

6 Claims, 3 Drawing Figures

INVENTOR:
GUY CROKETT CARR

BY:

ATTORNEY

Adrian J. LaRue

INVENTOR:
GUY CROKETT CARR

BY:

ATTORNEY

Adrian D. LaRue

METHOD FOR IMPREGNATING WOOD

This is a continuation of application Ser. No. 384,552, filed Aug. 1, 1973, and now abandoned, for Apparatus and Method For Treating Wood, which was a continuation of Ser. No. 172,767 filed Aug. 18, 1971, and now abandoned, for Apparatus and Method for Treating Wood.

BACKGROUND OF THE INVENTION

In order to preserve wood, preservative material is introduced into the wood. One way to introduce preservation material into the wood is in accordance with an autoclave process, wherein the material to be treated, such as wood, is placed within a vessel. Preservative or penetrating fluid is introduced into the vessel and it is closed. The vessel is heated thereby reducing the viscosity of the penetrating fluid and enhancing capillary action due to a slight increase in pore size in the pores of the wood, and a slight increase in pressure of the fluid due to thermal expansion.

Another way to introduce preservative material into the wood is by the osmosis process whereby water soluble salts are used whereby ion migration occurs across the cellular walls of the wood as a result of the moisture within the wood cells.

A further way to introduce preservative material into the wood is by way of the liquified petroleum gas process which involves the use of the liquified petroleum as a solvent to carry the preservative material within the wood, and this is done under a pressure of 75–100 p.s.i.

None of the foregoing processes are effective to distribute the preservative material throughout no more than 15 to 20 percent of the wood to be preserved. Thus, the outer area of the wood is preserved, and, after a period of time depending upon the environment, dterioration and decay of the wood begins.

The present invention causes the penetrating or preservative fluid to be distributed throughout 95 percent of the material to be treated by raising the pressure on the penetrating fluid by incremental levels, and intermediate each level the pressure is permitted to reach equilibrium with the functional and other forces being generated within the wood as the fluid thereinto. These incremental pressure equilibriums are continued until a maximum pressure is attained whereby expected penetration throughout substantially all of the wood by the fluid has occurred.

A primary object of the present invention is to provide a novel method for controllably introducing penetrating fluid into material.

Another object of the invention is the provision of a simple and efficient apparatus to carry out this method of treating material.

A further object of the invention is to provide treated material that has penetrating fluid throughout most thereof.

Still another object of the invention is the provision of treated material of uniform quality.

Other objects and advantages of the invention will become apparent as the description of the invention proceeds, reference being had to the accompanying drawing in which an apparatus is disclosed which illustrates the principles of the invention and in which.

It is well known that in a living tree, sap moves vertically within the cambium layer and penetrates the growing fiber through a network of capillary channels defined as pith rays which are radially oriented. Once a tree has been cut, this network is still present and in order to preserve the wood for various uses such as, for example, cross ties, fence posts, telephone or power poles, the present invention utilizes it to distribute preservative fluid throughout the wood which distribution can be up to 95 percent throughout the fibrous structure of the wood.

Figure 1:
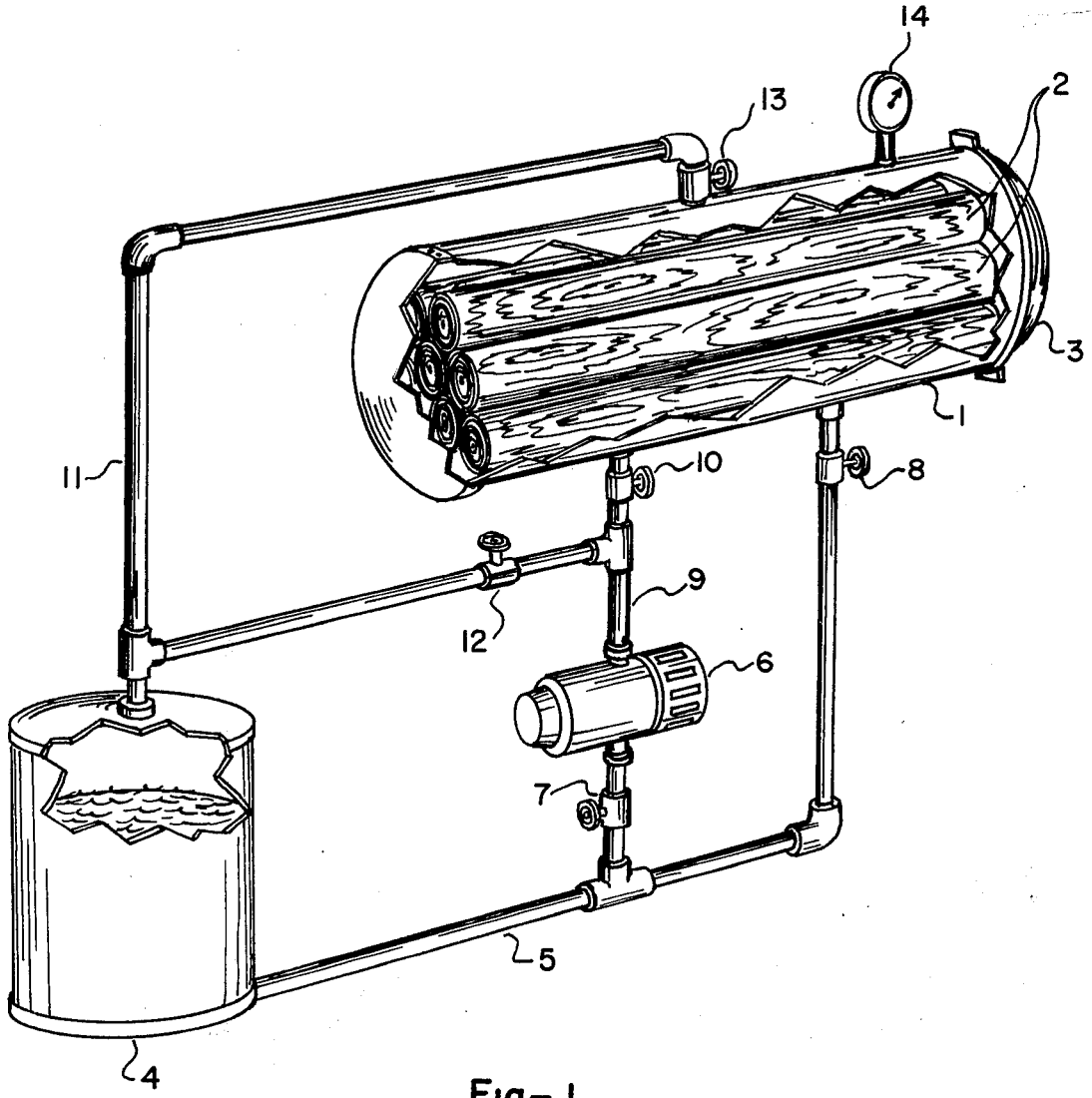
FIG. 1 is a diagrammatic view showing the apparatus for treating material in accordance with the principles of the present invention.

Turning to FIG. 1, a suitable pressure chamber includes a vessel 1 in which material 2 to be treated is disposed and a lid 3 which is preferably hingedly mounted on vessel 1 and is sealingly latched in position.

A storage tank 4 for storing penetrating fluid in the form of a preservative such as, for example, creosote or other suitable preservative, has pipe 5 connected to a conventional pump 6 via valve 7 and to vessel 1 via valve 8. A pipe 9 connects pump 6 through valve 10 to vessel 1, and pipe 9 is also connected to pipe 11 via valve 12. Pipe 11 has one end connected to vessel 1 through valve 13 and its other end is connected to storage tank 4. A pressure guage 14 of conventional construction is connected onto vessel 1.

In operation: material 2, such as wood, is loaded into vessel 1, and lid 3 is sealingly opened. Valves 7, 10 and 13 are closed. Pump 6 is actuated thereby pumping preservative fluid into the pressure chamber until it is filled thereby which can be determined by a sight means (not shown) provided by vessel 1.

Figure 3:
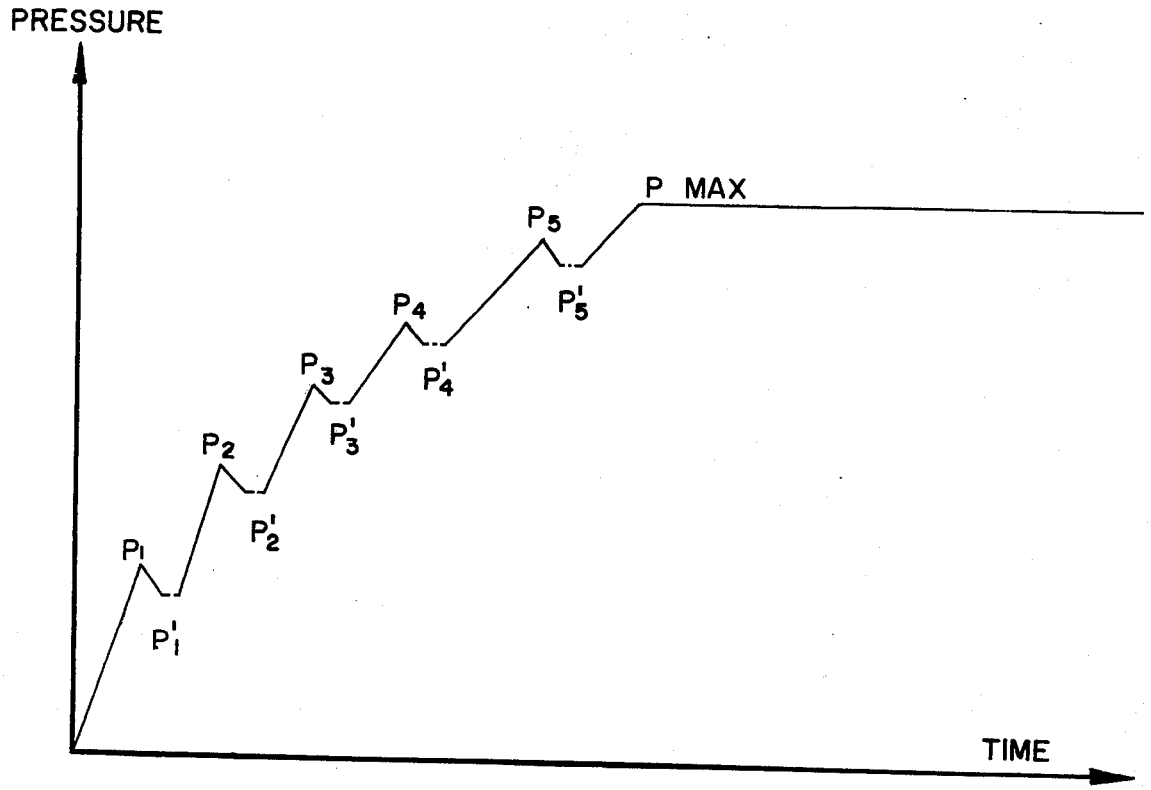
FIG. 3 is a graph illustrating the incremental pressures and intermediate pressure equilibriums over a period of time during the treating process.

Valve 13 is closed and pressure is raised to P1 level, as illustrated in FIG. 3 to provide isostatic pressure on the material and to force the fluid through the pores in the material as a result of the pressure which is independent of any capillary action through the pith rays. Valve 10 is then closed and valve 12 is opened which provides a by-pass so that pump 6 can continue to operate thereby maintaining a substantially constant pressure.

The pressure in pressure chamber PC drops to P'1 after a short period of time as a result of the pressure on the fluid reaching equilibrium with the frictional forces and any moisture and sap present in the wood.

After pressure P'1 stablizes, valve 12 is closed and valve 10 is opened and pump 6 pumps fluid into pressure chamber PC until pressure level P2 is reached whereupon valve 10 is closed and valve 12 is opened whereby the pressure drops to equilibrium level P'2 in the same manner as described hereinabove.

Figure 2:
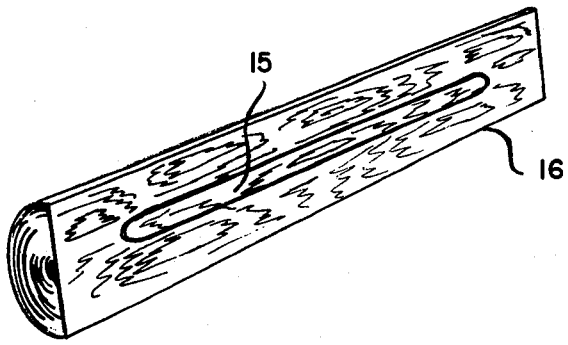
FIG. 2 is a perspective cross-sectional view of a piece of wood after being treated with penetrating fluid.

The same steps as heretofore described are repeated until P Max. is reached which is the point at which the pressure stays constant. This indicates that the preservative material has been distributed throughout substantially all of the capillary network of the wood and has driven and concentrated the moisture and sap in the wood in an elongated area 15 in wood 16 as illustrated in FIG. 2. Valves 8 and 13 are opened to permit the penetrating fluid to return to storage tank 4 since valve 13 opens the system to atmospheric pressure whereupon lid 3 can be opened and the treated material removed from pressure chamber PC.

As penetration is taking place from the outer layers of the wood towards the center thereof and all of the cellular structure is filled by the fluid, the fibers can support greater pressures after each equilibrium level has been reached. The maximum pressure that is attained is that pressure which can be applied to each individual fiber before it is destroyed instead of the pressure required to crush an array of unsupported fibers.

This has been confirmed by applying a pressure of 1000 p.s.i. on fluid forced into lodegepole Pine whereupon it was crushed and no significant penetration was achieved. However, the same kind of wood, when subjected to a maximum pressure of 1,200 p.s.i. in accordance with the present invention, 95 percent penetration of the wood was attained and no destruction of the fibers of the wood occurred. Above 1,200 p.s.i., delamination, which is individual fiber breakdown, began to occur but excellent penetration has been obtained.

The present invention can be practiced on wood in its green or dry state and it is to be noted that the maximum pressure to obtain maximum penetration of the preservative fluid depends on the type of wood and whether or not it has been processed into lumber. A graph, such as FIG. 3, can be provided for each type of wood so that optimum penetration can be achieved by following the graph. Penetration of the fluid can be controlled by the pressure-controlling means of the apparatus of FIG. 1 so that any desirable penetration up to maximum penetration can be obtained as desired. The penetration fluid can be other than preservative fluid. The material can be any material having a cellular construction into which fluid can be forced.

Although the preferred embodiment of the invention has been herein described, it will be obvious to those skilled in the art that various modifications may be made in the details of the invention without departing from the principles herein set forth.

The invention is claimed in accordance with the following:

1. A method of impregnating members having a fibrous, capillary, cellular construction capable of fluid impregnation with a penetrating fluid comprising the steps of:

a. placing the members to be impregnated within a pressure chamber;

b. sealing said pressure chamber;

c. supplying said sealed pressure chamber with said penetrating fluid until said pressure chamber is filled therewith and until a first predetermined pressure level is reached within said pressure chamber;

d. discontinuing the supply of said penetrating fluid into said sealed pressure chamber without venting the chamber for a time sufficient to permit the pressure level in said sealed pressure chamber to decrease to a first stabilized pressure level below said first predetermined pressure level due to the pressure of said penetrating fluid attaining equilibrium with the frictional and other forces in the cells of said member;

e. repeating steps (c) and (d) so that said penetrating fluid is intermittently pumped into said sealed pressure chamber to successively increased pressure levels until a maximum pressure level is reached.

2. A method according to claim 1 wherein said maximum pressure level comprises the pressure level at which no decrease in pressure occurs after the supply of the penetrating fluid to the pressure chamber is discontinued, whereby said penetrating fluid has penetrated a substantial portion of the cellular construction of said members.

3. A method according to claim 1 wherein said penetrating fluid is maintained under pressure after each discontinuation of the supply thereof to said sealed pressure chamber.

4. A method according to claim 1 wherein the members of cellular construction are of wood.

5. A method of impregnating wood with a penetrating fluid comprising the steps of:

a. placing wood within a pressure chamber;

b. sealing the pressure chamber;

c. pumping said penetrating fluid into said sealed chamber from a supply vessel until said chamber is full and a first predetermined pressure level is reached therein; and d. diverting said penetrating fluid which is being directed to the pressure chamber back to said supply vessel while maintaining the chamber sealed, so that the supply of said penetrating fluid to said chamber is discontinued for a time sufficient to permit the pressure in said sealed pressure chamber to decrease to a first stabilized level below said predetermined pressure level due to the pressure of said penetrating fluid attaining equilibrium with the friction and other forces being generated within the cellular construction of said wood;

e. repeating steps (c) and (d) so that said penetrating fluid is intermittently pumped into said sealed pressure chamber to successively increased pressure levels until a maximum pressure level is reached.

6. A method according to claim 5 including the step of maintaining the penetrating fluid in the supply vessel under pressure after diverting the fluid thereto.

* * * * *